United States Patent [19]

Murphy

[11] 4,421,000

[45] Dec. 20, 1983

[54] HOLE PUNCHING DEVICE

[76] Inventor: Ina H. Murphy, 5610 Minden, Houston, Tex. 77026

[21] Appl. No.: 263,932

[22] Filed: May 15, 1981

[51] Int. Cl.[3] ..... B26F 1/04

[52] U.S. Cl. ..... 83/372; 83/513; 83/522; 83/571; 234/108

[58] Field of Search ..... 83/571–573, 83/575–577, 522, 372, 549, 513–519, 691; 234/51, 102–108, 131

[56] References Cited

U.S. PATENT DOCUMENTS

| | | | |
|---|---|---|---|
| 2,618,338 | 11/1952 | Bennes | 234/108 X |
| 2,923,354 | 2/1960 | Pobog et al. | 234/103 X |
| 2,957,380 | 10/1960 | Duncan et al. | 83/549 |
| 2,985,052 | 5/1961 | Mentz et al. | 83/522 |
| 3,427,914 | 2/1969 | Staats et al. | 83/571 X |
| 3,525,471 | 8/1970 | Keen | 234/108 X |
| 3,644,932 | 2/1972 | Wallace et al. | 83/577 X |
| 3,667,334 | 6/1972 | Brunett | 83/372 X |
| 3,874,584 | 4/1975 | Foley | 234/131 X |
| 4,000,673 | 1/1977 | Lyon | 83/571 X |

FOREIGN PATENT DOCUMENTS

| | | | |
|---|---|---|---|
| 1421351 | 11/1965 | France | 234/108 |

*Primary Examiner*—James M. Meister
*Attorney, Agent, or Firm*—Guy E. Matthews

[57] ABSTRACT

An improved apparatus is disclosed for simultaneously electrically selecting an array of punches for forming holes in paper suitable for engagement with loose leaf binders or the like. The punches are electrically activated and are mounted in a housing and include a switch mounted on the housing whereby the insertion of paper into the housing will automatically activate the punches which simultaneously form holes in the paper. A corresponding set of indicator lights may be mounted on the housing to signal which punches have been selected.

2 Claims, 3 Drawing Figures

HOLE PUNCHING DEVICE

BACKGROUND OF THE INVENTION

The present invention relates to devices for punching holes in stacks of paper sheets are the like for accomodating various loose leaf binder systems. Specifically the present invention relates to an apparatus for simultaneously selecting a specific array of electrically powered punching dies required by a specific loose leaf binder design.

Devices for punching holes in paper or the like have been known extensively in the past. Single punch devices have been found to be slow and difficult to manually align.

U.S. Pat. No. 3,987,695, issued to Neilson, discloses a single punch device with a rotatable multifaced bar, each face having a series of indents marking the location of a hole for a particular array of holes. A face of the bar is selected, the punch is pulled along the length of the face until an indent is encountered, at which time the punch is hand operated to form a hole. This concept, although providing alignment is extremely labor intensive and slow to operate, and is limited in a number of arrays that it can accomodate.

U.S. Pat. No. 2,985,052, issued to Mentzer et al, discloses a device for simultaneously punching a plurality of aligned holes. A plurality of uniformly spaced punches may be selectively engaged with an electric motor or the like. This provides some selectivity, but the engagement of the holes must be done individually, consequently conversion from one array to another is extremely slow and subject to human error. Also, the explicit limitation to uniform spacing of the punching dies may exclude many common arrays of loose leaf binder holes.

Thus, it is desirable to provide an apparatus for quickly and accurately modifying a punching apparatus when converting to and from various arrays of hole patterns.

SUMMARY OF THE INVENTION

The present invention recites an apparatus for punching holes which permits that simultaneous selection of specific dies out of a plurality of linearly aligned electrically powered dies. Further, the present invention includes a plurality of indicator lights to inform an operator as to which punching dies have been selected. A trip switch is used to detect the presence of a stack of paper inserted in the device, thereby simultaneously activating the punching dies previously selected.

Therefore, a principal feature and advantage of the invention is to enable the simultaneous selection of a desire array of punching dies.

Yet another feature and advantage of the invention is to automatically indicate which dies have been selected at a given time.

Therefore these and numerous other features and advantages of the invention will become more clearly evident upon a careful reading of the following detailed description, claims, and drawings, wherein like numerals denote like parts in the several views, and wherein:

DETAILED DESCRIPTION OF THE INVENTION

Figure 1:
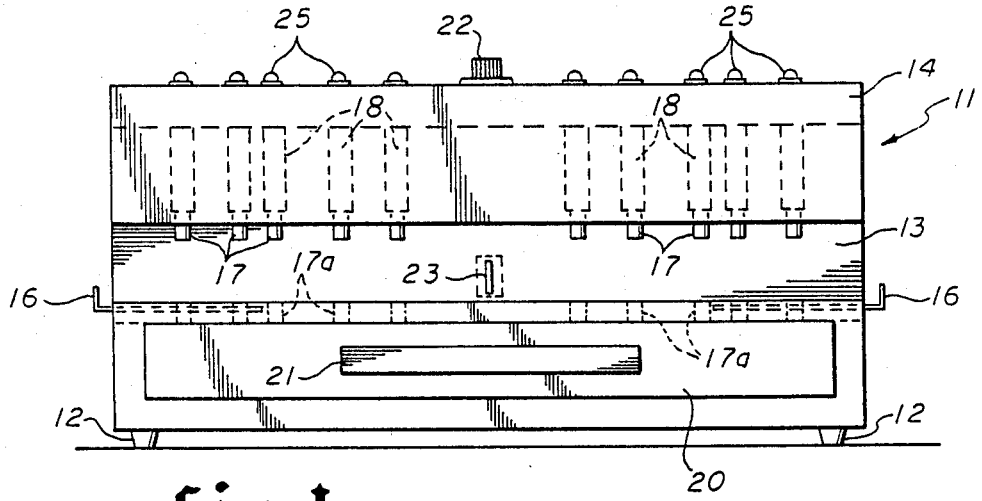
FIG. 1 shows a frontal view of the invention.
Figure 2:
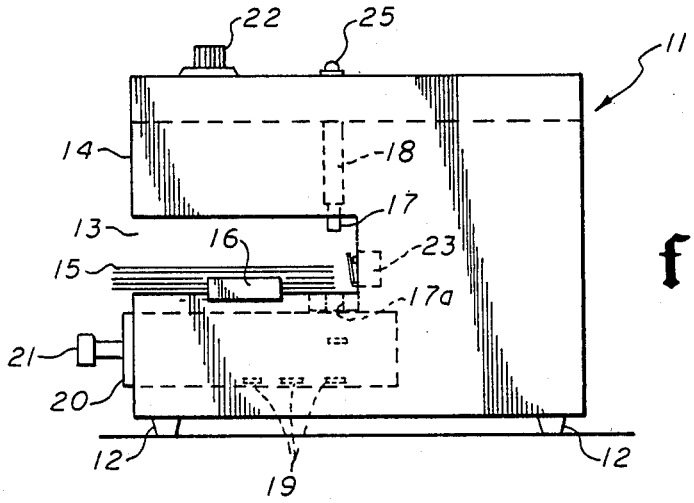
FIG. 2 shows a right side view of the invention.
Figure 3:
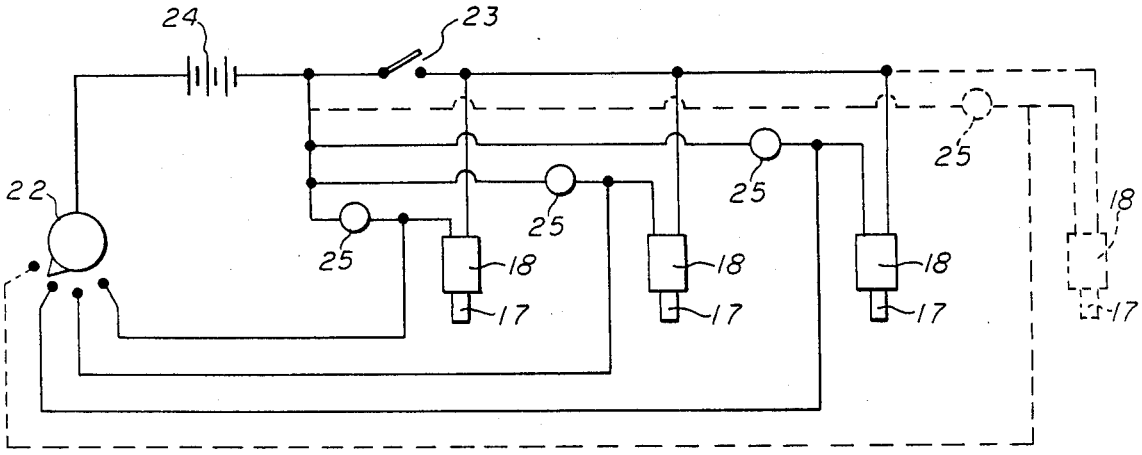
FIG. 3 shows a simplified schematic of an embodiment of the invention.

Referring now to FIG. 1, the numeral 11 generally indicates the housing which contains or supports the hole punching mechanism of the claimed invention.

The housing 11 may be suitably raised off a supporting surface by a plurality of feet 12. An opening or slot 13 extends across the front surface 14 of the housing 11. The opening 13 permits the insertion of the desired thickness of paper 15 into the housing. One or more guide brackets 16 may be slidably engaged with the housing 11 so as to assist in the positioning of a variety of paper lengths. Additionally markings or other indicia (not shown) may be created on the housing to visually guide the paper as it is being inserted.

Mounted within the housing are a plurality of punches 17. Each punch is activated by an electromechanical power source 18, such as an electric motor or solenoid. In the preferred embodiment of the invention, 11 punches and solenoids are arranged as shown in FIG. 1 to accomodate most common loose leaf binder arrays. This arrangement includes eleven (11) linearly aligned punches and actuators, including a first punch having a center point defining mid-point, a second punch having a center point 1.375 inches from the center point of the first punch, said second punch defining a first side with respect to the first punch, a third punch having a center point 1.375 inches away from the first punch and 2.75 inches away from the second punch, defining a second side with respect to the first punch, a forth punch 2.125 inches away from the first punch on said first side, a fifth punch 2.125 inches away from the first punch on said second side, a sixth punch 3.000 inches away from the first punch on said first side, and a seventh punch 3.000 inches away from the first punch on said second side, an eighth punch 3.500 inches away from the first punch on said first side, and a ninth punch 3.500 inches away from the first punch on said second side, and a tenth punch being 4.250 inches away from the first punch on said first side, and an eleventh punch being 4.250 inches away from the first punch on said second side. The punches 17 are so mounted within the housing that when the electro-mechanical power source 18 is activated the punch will forceably descend through the opening 13 and any paper 15 positioned therein, and then through an aligned opening 17*a*, thereby creating the desired hole in the paper. The waste paper, or confetti, 19 is deposited in a removable tray 20, slidably engaged with the housing 11, with a handle 21 allowing the disposal of the confetti upon a sufficient accumulation in the tray.

A multiple position switch 22 is mounted on the housing 11. Each position of the switch represents a different array of punches. Multiple position switch 22 is connected by an electric circuit to an electric power source 24 and a trip switch 23. The trip switch 23 is mounted in the opening 13 so as to be in a closed position only when paper is inserted fully into the housing 11, whereby the presence of said paper may be detected.

In one embodiment of the invention an electric circuit also connects each position on the multiple position switch with the particular punches and solenoids represented by that position on the switch. Thus once the trip switch 23 is closed, a circuit is completed, whereby all selected solenoids 18 are activated, forcing the punches 17 through the paper 15 simultaneously.

In an alternative embodiment of the invention, the inclusion of a particular punch in the circuit as represented by a position on the multiple position switch 22 may be accomplished electronically, for instance, by the use of an appropriately constructed ROM (read only memory) 30. The rom 30 thus requires one set of wires to selectively connect the appropriate punches 17 with the multiple position switch 22, the trip switch 23 and the power source 24 so as to form a completed circuit when the trip switch is closed.

Additionally, a plurality of indicator lights 25 or the like may be mounted on the housing 11 and connected with the power source 24 and the multiple position switch 22 whereby the illumination of a particular indicator light 25 indicates the selection of a particular punch and solenoid represented by a position on the switch 22.

It should be understood by the reader hereof, that the description of the invention herein is set forth for exemplary purposes only and that various changes and/or modifications may be made hereto without departing from the spirit and scope of the invention claimed hereafter.

Therefore, that which is claimed and desired to be selected by United States Letters Patent is:

1. An improved electrically powered paper hole punching device, comprising:

(a) a housing, having a front surface, and including a removable tray mounted on a bottom surface thereof;

(b) a plurality of linearly aligned punches mounted within the housing, said punches spaced in accordance with hole spacing requirements of loose leaf binders;

(c) a plurality of electrically powered actuator means, each actuator means connected to one punch;

(d) selection means for simultaneously selecting one or more of the punches for inclusion in an electric circuit;

(e) guide means mounted on the housing for positioning the paper in relation to the front surface of the housing and the punches;

(f) a first switch means mounted in the housing for detecting the presence of paper in position with respect to the housing and the punches;

(g) an electric circuit connecting those punches and actuators selected with the first switch means and the selection means whereby the insertion of paper into the housing will close the first switch means so as to complete the electric circuit and to activate the punches thereby forming holes in the paper;

(h) actuator means comprised of a solenoid, the shaft of said solenoid being axially aligned with and affixed to said punch; and, (i) electrical indicator means for signaling which punches and actuator means have been included in the electric circuit.

2. The device of claim 1, wherein the electrical indicator means comprises:

a plurality of lights mounted on the housing.

* * * * *